US007572151B2

(12) United States Patent
Lee

(10) Patent No.: US 7,572,151 B2
(45) Date of Patent: Aug. 11, 2009

(54) PLUG CONNECTOR FOR MOBILE COMMUNICATION DEVICE

(75) Inventor: Seung-Hee Lee, KyungKi-Do (KR)

(73) Assignee: Korea Air Electronic Co., Ltd, Ansan-si (KR)

( * ) Notice: Subject to any disclaimer, the term of this patent is extended or adjusted under 35 U.S.C. 154(b) by 0 days.

(21) Appl. No.: 11/950,108

(22) Filed: Dec. 4, 2007

(65) Prior Publication Data

US 2008/0227339 A1 Sep. 18, 2008

(30) Foreign Application Priority Data

Mar. 15, 2007 (KR) ..... 10-2007-0025289
Nov. 19, 2007 (KR) ..... 10-2007-0117633

(51) Int. Cl.
*H01R 24/00* (2006.01)

(52) U.S. Cl. ..... 439/630; 439/59; 439/76.1; 439/607

(58) Field of Classification Search ..... 439/607–610, 439/76.1, 59, 630
See application file for complete search history.

(56) References Cited

U.S. PATENT DOCUMENTS 6,685,509 B1 * 2/2004 Yeh ..... 439/607
7,144,258 B2 * 12/2006 Ariga et al. ..... 439/76.1

FOREIGN PATENT DOCUMENTS

KR 409587 Y1 2/2006
KR 418058 Y1 6/2006

* cited by examiner

*Primary Examiner*—Truc T Nguyen
(74) *Attorney, Agent, or Firm*—Sughrue Mion, PLLC

(57) ABSTRACT

A plug connector for a mobile communication device is provided. The plug connector includes a plurality of contact pins, an insulator, and an outer shell. The contact pins are provided correspondingly to contact terminals of a socket connector for the mobile communication device, and are arranged with predetermined gaps therebetween. The insulator supports the contact pins. The outer shell encloses the insulator, and includes a substrate supporter extended outwardly from the insulator to support an outer surface of a PCB (printed circuit board). The substrate supporter comprises a side supporter enclosing lateral sides of the PCB, and a ground portion bonded to put to earth to a ground circuit of a PCB. The plug connector is capable of firmly bonding with a PCB, preventing from noise occurring.

6 Claims, 10 Drawing Sheets

PLUG CONNECTOR FOR MOBILE COMMUNICATION DEVICE

BACKGROUND OF THE INVENTION

1. Field of the Invention

The present invention relates to an electrical connector for a mobile communication device, and more particularly, to a plug connector for a mobile communication device.

2. Description of the Related Art

Generally, electrical connectors are used to electrically connect a plurality of electrical devices. In a mobile communication device, a connector for connecting a data cable or a power cable to the mobile communication device usually includes a socket provided on the mobile communication device, and a plug provided on the cable for detachably fitting to the socket.

In a conventional plug connector disclosed in Korean Utility Model No. 418058 (published on Jun. 9, 2006) entitled "Pin holder having pin for improving contact efficiency", which is hereby incorporated by reference, a contact pin not only electrically contacts terminals of a printed circuit board (PCB), but also supports the outer surfaces of the PCB. However, a reduction in the number of contact pins causes a problem of insufficient support.

That is, when the number of contact pins is 20, the upper and lower surfaces of the PCB are respectively supported by 10 contact pins, so that the PCB may be supported solely by the contact pins; however, when the number of contact pins is 4 or 8, the amount of support that the pins provide decreases drastically.

Also, because conventional contact pins only support a PCB at the upper and lower surfaces thereof, the PCB can easily shift laterally.

Again, with respect to Korean Utility Model No. 418058 (published on Jun. 9, 2006), because the pins are difficult to insert into receptacles, the pins can bend laterally, whereupon a short can occur when adjacent pins are brought into contact with each other.

In Korean Utility Model No. 409587 (published on Feb. 22, 2006) entitled "Pin Holder", which is hereby incorporated by reference, a pin is provided as two types—one with a rear end bent to contact the upper surface of a PCB, and the other bent to contact the lower surface of the PCB. Here, the rear portion of the pin is inserted and coupled inside an insulator so that the front contacting end of the pin must be bent substantially toward the bent rear end of the pin to facilitate the pin's contact with the contact terminal of the connector's socket. Thus, because the contacting leading end of the pin is bent upward and the moment of the contact terminal of the connector's socket is large, when the contact terminal is pushed against the pin, the pin and the contact terminal may be pushed apart from one another after prolonged use, resulting in defective contact therebetween.

Also, in case that a conventional plug connector is used for an earphone jack, the outer shell thereof does not put to earth so that results in noise occurrence.

Again, a conventional plug connector did not join firmly to a PCB so that separated from a socket connector it apart easily from the PCB.

SUMMARY OF THE INVENTION

Accordingly, the present invention is directed to a plug connector for a mobile communication device that substantially obviates one or more problems due to limitations and disadvantages of the related art.

Embodiments of the present invention provide a plug connector for a mobile communication device capable of firmly bonding with a PCB being in contact with a contact pins.

Embodiments of the present invention also provide a plug connector for a mobile communication device capable of preventing defective contact between a contact pin and a socket connector through a firm coupling between the contact pin and an insulator, and capable of preventing short circuits between contact pins.

Embodiments of the present invention also provide a plug connector for a mobile communication device capable of preventing from making a noise in the earphone.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

In one aspect of the present invention, there is provided a plug connector for a mobile communication device, including: a plurality of contact pins provided correspondingly to contact terminals of a socket connector for the mobile communication device, and arranged with predetermined gaps therebetween; an insulator supporting the contact pins; and an outer shell enclosing the insulator, and including a substrate supporter extended outwardly from the insulator, for supporting an outer surface of a PCB (printed circuit board) being in contact with the contact pins.

The substrate supporter may include a side supporter enclosing lateral sides of the PCB.

The side supporter may have a cross-sectional 'ㄷ' shape.

Also, the substrate supporter comprises a ground portion bonded to put to earth to a ground circuit of a PCB.

The ground portion is extended outwardly from end of the side supporter.

The substrate supporter may include an upper supporter supporting an upper surface of the PCB, and a lower supporter supporting a lower surface of the PCB.

Also, the insulator includes a PCB receptacle for receiving a part of a PCB, and the PCB includes a support portion projected for inserting into the PCB receptacle.

The insulator may include a recess for receiving front ends of the contact pins, each of the contact pins may include a contact portion for contacting a contact terminal of the socket connector, and the contact portion may have a guide portion protruding from an end thereof for inserting in the recess.

Each of the contact pins may have a rear bent portion for contacting an outer surface of the PCB, and the rear bent portion may be exposed outwardly from the outer shell.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein.

Figure 1:
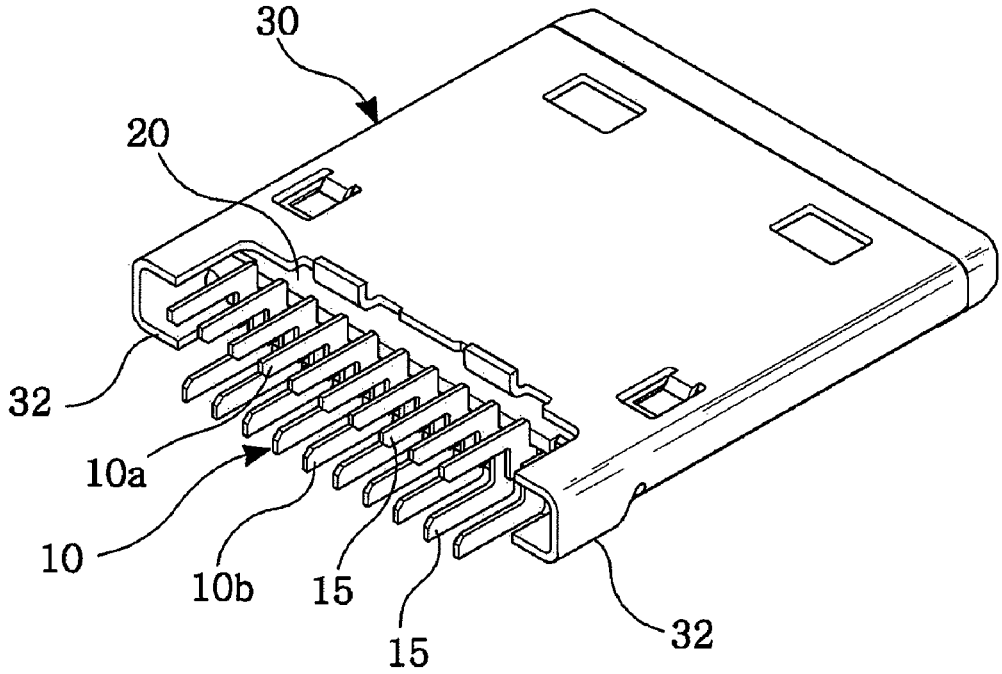
FIG. 1 is a perspective view of a plug connector for a mobile communication device according to an embodiment of the present invention.
Figure 2:
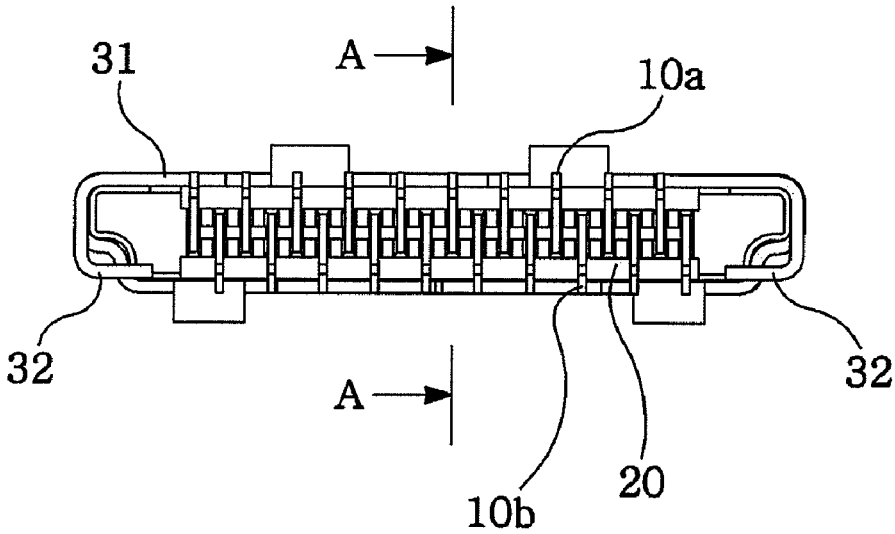
FIG. 2 is a side view of the plug connector in FIG. 1.
Figure 3:
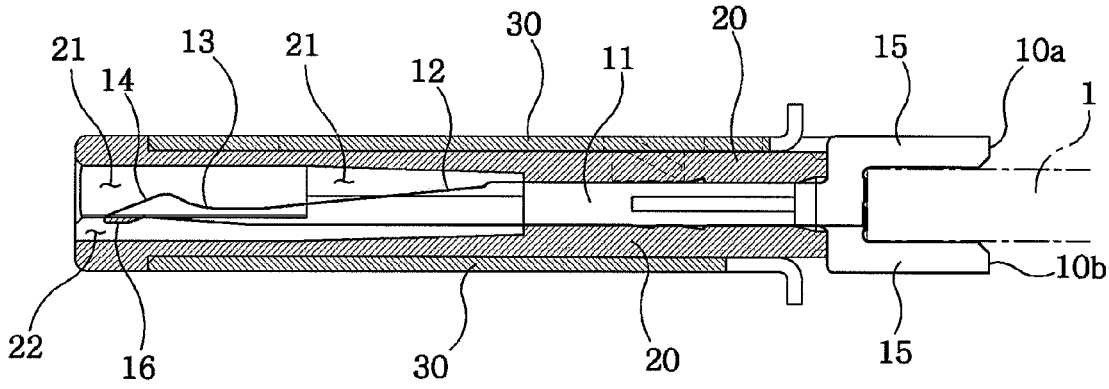
FIG. 3 is a schematic sectional view of the plug connector in FIG. 2 taken along line A-A.
Figure 4:
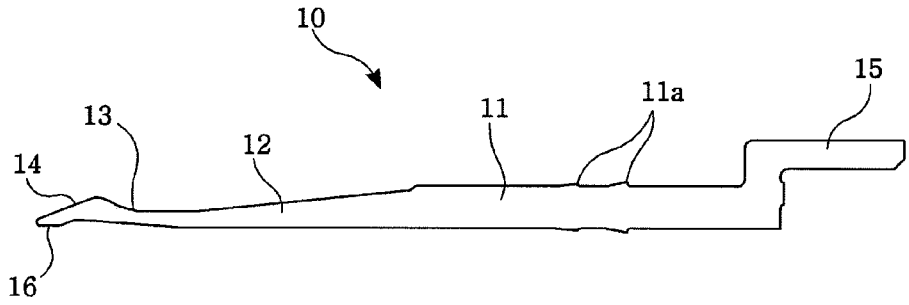
FIG. 4 is a side view of a contact pin in FIG. 3.
Figure 5:
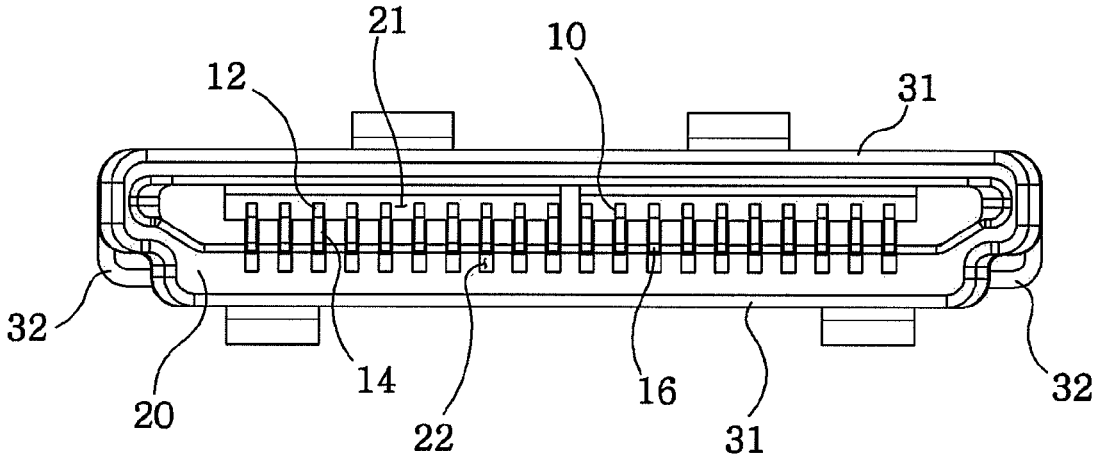
FIG. 5 is a sectional side view of the plug connector in FIG. 3.
Figure 6:
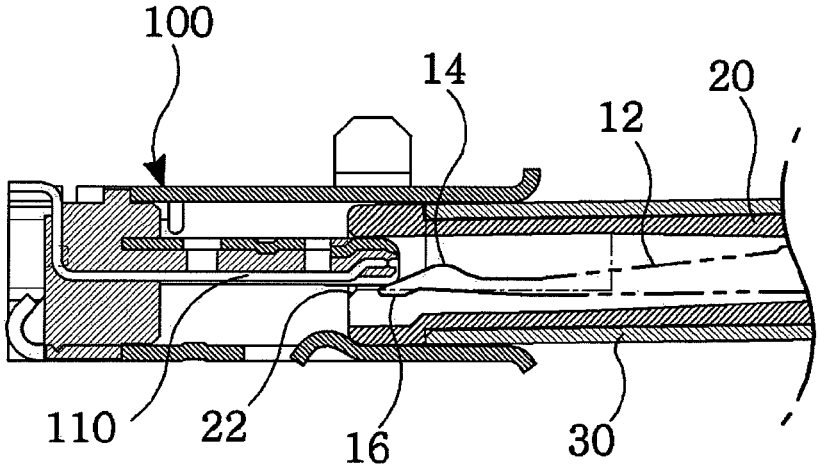
FIGS. 6 and 7 are schematic side views showing contact between the plug connector and socket shown in FIG. 3.
Figure 7:
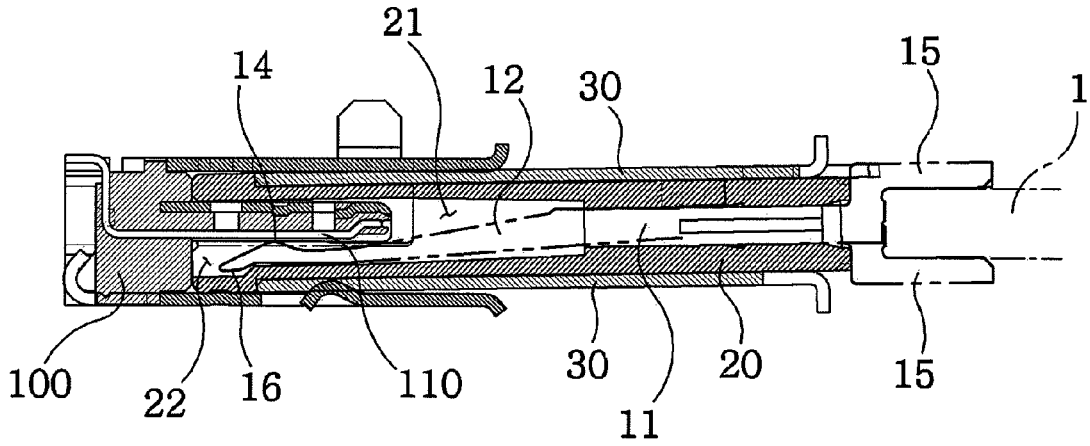

Referring to FIGS. 6 and 7, a plug connector for a mobile communication device according to the present invention is a part that detachably inserts in a socket connector 100 of the mobile communication device. The socket connector 100 couples to the PCB of the mobile communication device, and the plug connector is coupled to a PCB 1 of a device to be connected to the mobile communication device.

Referring to FIGS. 1 through 7, a plug connector of a mobile communication device according to one embodiment of the present invention includes a plurality of contact pins 10 with predetermined gaps therebetween, an insulator 20 supporting the contact pins 10, and an outer shell 30 enclosing the insulator 20.

A contact pin 10 includes a pin body 11 supported by the insulator 20, an arm 12 extending from the front end of the pin body 11, a wrist 13 formed in a constricted manner at the front of the arm 12, a contact portion 14 extending from the front of the wrist 13, and a rear bent portion 15 extending from the rear end of the pin body 11.

The plug connector according to the present embodiment has a total of 20 (10×2) contact pins that contact the PCB.

The pin body 11 is coupled to protrude through the insulator 20. The pin body 11 is provided with stoppers 11*a* formed to protrude therefrom, so that the contact pin 10 can support the PCB without being released toward the PCB.

The contact portion 14 contacts a contact terminal 110 of the socket connector 100. The wrist 13 is formed in a constricted manner between the arm 12 and the contact portion, so that the degree of contact is elevated when the contact portion 14 contacts the contact terminal 110 of the socket connector 100.

The arm 12 is made to elastically deform so that the contact portion 14 can contact the contact terminal 110 of the socket connector 100.

The insulator 20 includes a pin receptacle 21 for receiving the contact pins 10, and the pin receptacle 21 has a plurality of recesses 22 formed to correspond to the contact pins 10 in an inner wall thereof.

A guide portion 16, at one end of the contact portion 14 that inserts into the recess 22, is formed to slant downward.

The guide portion 16 is formed on the one end of the contact portion 14 to slant downward so that the contact pin always couples to the insulator 20 while inserted in the recess 22. That is, the guide portion 16 always guides the contact pin 10 so that it never moves laterally when the contact portion 14 is in contact with the contact terminal 110 of the socket connector 100, and also when the contact portion 14 is not in contact with the contact terminal 110 when the contact pin 10 is inserted into the recess 22. Therefore, a short occurring between one contact pin 10 and an adjacent contact pin 10 can be averted.

Here, the arm 12 is formed to extend in a straight line in a lengthwise direction of the pin body 11, and the contact pin 14 only protrudes higher than the wrist 13, and does not actually protrude higher than the arm 12; at the same time, the guide portion 16 protrudes downward from the front end of the contact portion 14 to be lower than wrist 13.

Accordingly, when the contact terminal 110 of the socket connector 100 is inserted in the pin receptacle 21 and contacts the contact portion 14, the moment of the arm 12 and the contact portion 14 with respect to the pin body 11 is minimized so that deformation leading to faulty contact of the contact pin 10 can be averted.

That is, the contact portion 14 and the guide portion 16 are formed along an almost in-line extension with respect to the arm 12, and that line of extension and the inserting direction of the contact terminal 110 of the socket connector 100 has a minimal height difference, so that the moment can be minimized.

The rear bent portion 15 of the contact pin 10 protrudes out from the insulator 20 so that the pin body 11 can be disposed at the center of the insulator 20. This reduces the height discrepancy in the inserted direction of the arm 12 of the contact pin 10 and the contact terminal 110 of the socket connector 100.

The contact pin 10 is divided into a first contact pin 10*a* and a second contact pin 10b, according to the bent direction of the rear bent portion 15. The first contact pin 10*a* is bent toward the upper surface of the PCB 1, and the second contact pin 10*b* is bent toward the lower surface of the PCB 1.

The first contact pin 10*a* is not only electrically connected to upper surface terminals, but also supports the upper surface of the PCB 1, and the second contact pin 10*b* is not only electrically connected to lower surface terminals of the PCB 1, but also supports the lower surface of the PCB 1.

Although the rear bent portions 15 of the first contact pins 10*a* and the second contact pins 10*b* are bent in opposite directions, the pin bodies 11 are all coupled at the same height to the insulator 20. As described above, each of the rear bent portions 15 of the first and second contact pins 10*a* and 10*b* protrude outside the insulators 20, so that each of the pin bodies 11 can be disposed at the center of the insulators 20. This is to locate the arms 12 at the center of the pin receptacle 21. Thus, the height of the arm 12 is nearly at the same height as the inserting height of the contact terminal 110 of the socket connector 100.

The rear bent portion 15 is supported by the outer surface of the insulator 20, so that the contact pin 10 is prevented from moving toward the pin receptacle 21.

The outer shell 30 includes a shell body 31, and a substrate supporter for supporting the outer surface of the PCB 1.

The shell body 31 encloses the outside of the insulator 20 to increase the strength of the insulator 20.

The substrate supporter extends outwardly with respect to the insulator 20, and supports the outer surface of the PCB 1.

Referring to FIGS. 1, and 8 through 10, the substrate supporter includes a side supporter 32 that encloses the lateral sides of the PCB 1, an upper supporter for supporting the upper surface of the PCB 1, and a lower supporter 34 for supporting the lower surface of the PBC 1.

Figure 8:
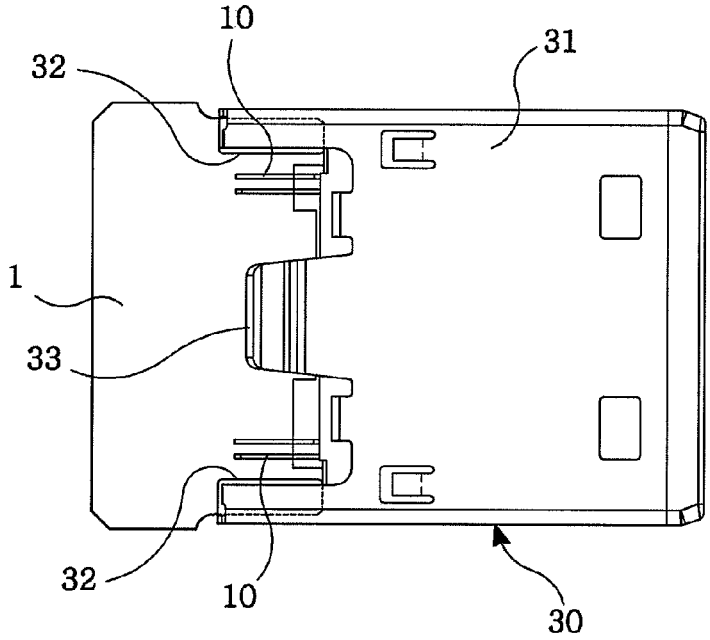
FIGS. 8 and 9 are plan and side views of a plug connector for a mobile communication device according to other embodiment of the present invention.
Figure 9:
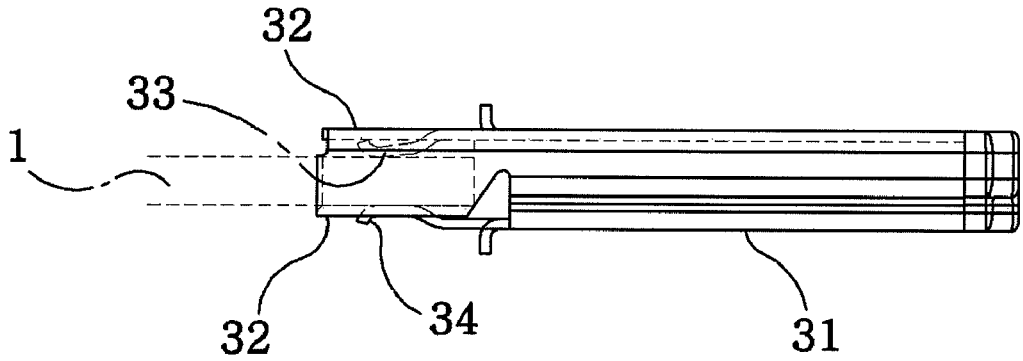
Figure 10:
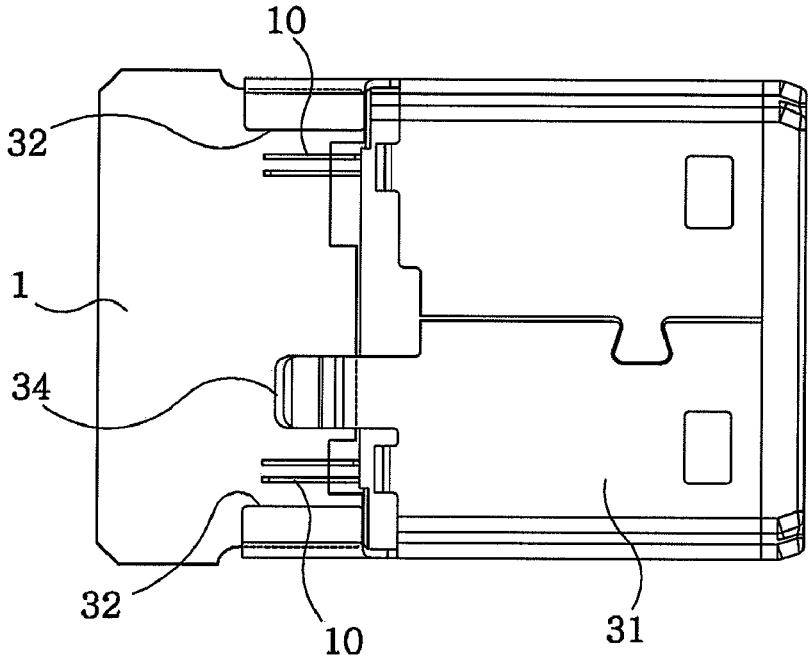
FIG. 10 is a bottom view of the plug connector in FIG. 9.
Figure 11:
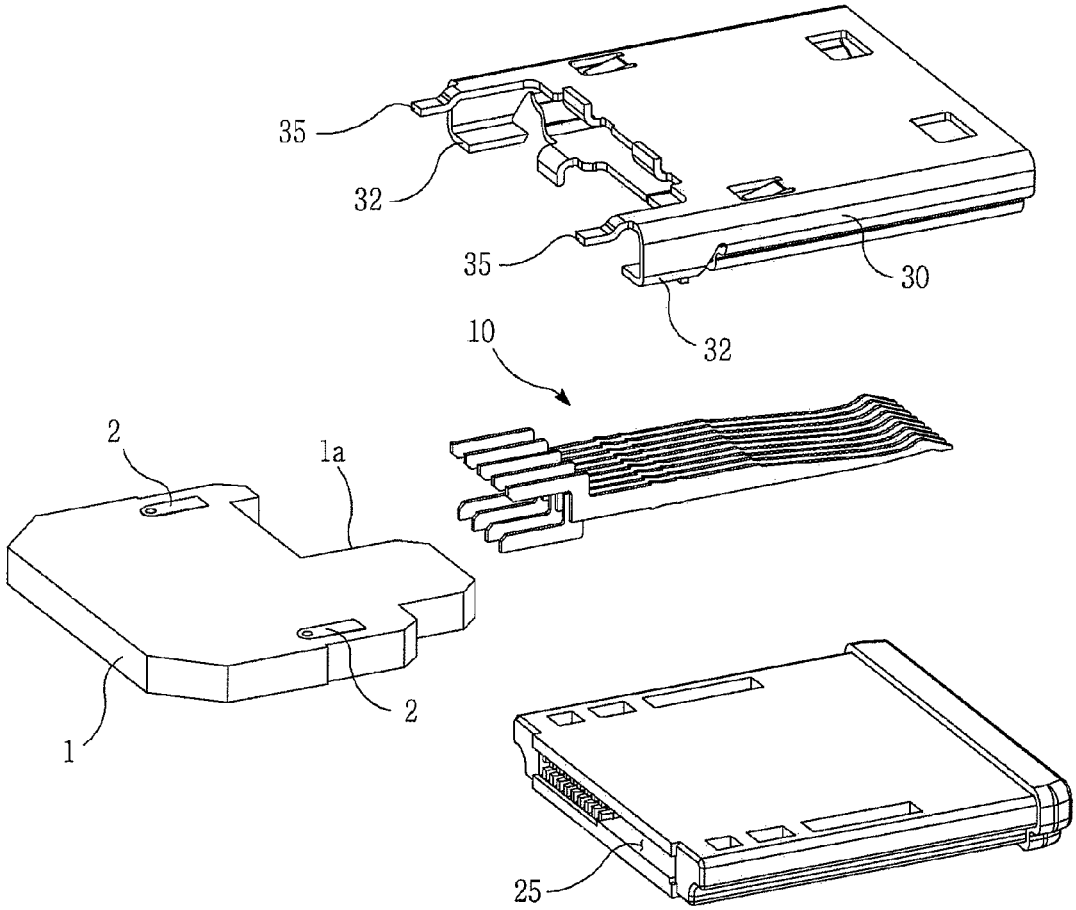
FIGS. 11 is a perspective view of a disassembly of a plug connector for a mobile communication device according to another embodiment of the present invention.
Figure 12:
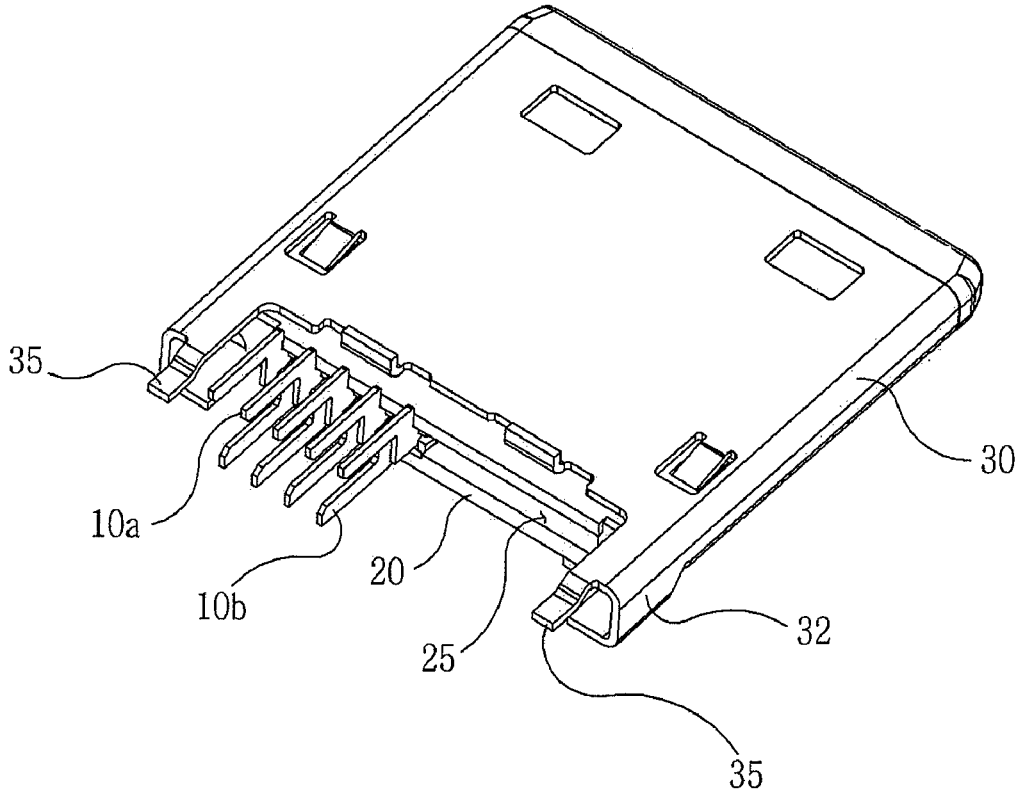
FIG. 12 is a perspective view of an assembly of the plug connector for a mobile communication device in FIG. 11.
Figure 13:
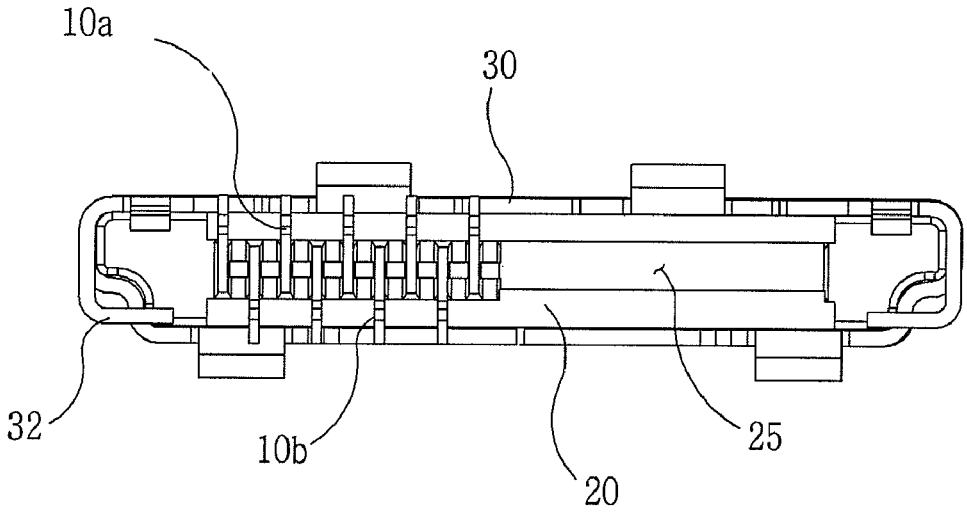
FIG. 13 is a side view of the plug connector in FIG. 12.

The embodiment in FIGS. 8 through 10 shows a connector for a PCB 1 with a total of eight contact pins 10 (4×2).

The side supporter 32 has a cross-sectional 'ㄷ' shape to enclose the lateral sides of the PCB 1.

That is, the side supporter 32 contacts the sides of the PCB 1 to support the PCB 1 from moving laterally and undulating. The side supporter 32 also contacts the upper and lower edge surfaces of the PCB 1 to prevent the PCB 1 from moving vertically, in concert with the upper supporter 33 and the lower supporter 34.

The upper supporter 33 and the lower supporter 34 extend in a cantilevered fashion from the front end of the shell body 31. The upper supporter 33 and the lower supporter 34 are also bent toward the PCB 1 and elastically deformed to elastically support the PCB 1.

The upper supporter 33 and the lower supporter 34 have respective front ends bent in opposite directions from the PCB 1 in an outwardly opening direction, allowing for easy insertion of the PCB 1.

The space between the above-described side supporter 32 and upper supporter 33 and that between the side supporter 32 and the lower supporter 34 have the contact pins 10 arranged therein.

Referring to FIGS. 11 through 17, a plug connector of a mobile communication device according to another embodiment of the present invention will now be made in detail.

In this embodiment the substrate supporter includes a ground portion 35 bonded to put to earth to a ground circuit 2 of the PCB 1.

The ground portion 35 is extended outwardly from end of the side supporter 32.

Figure 14:
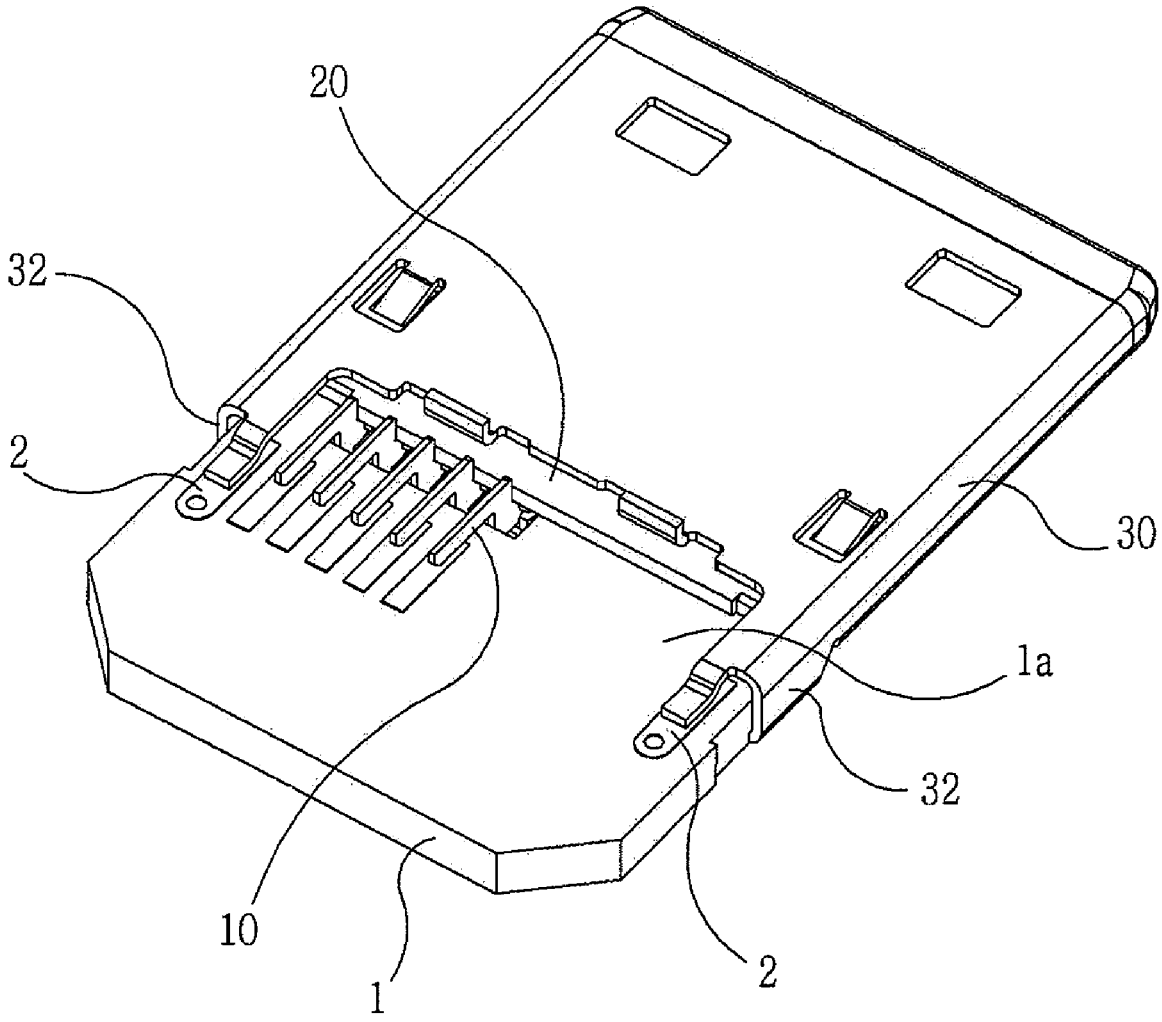
FIG. 14 is a perspective view of a join of the plug connector in FIG. 12 and a PCB.
Figure 15:
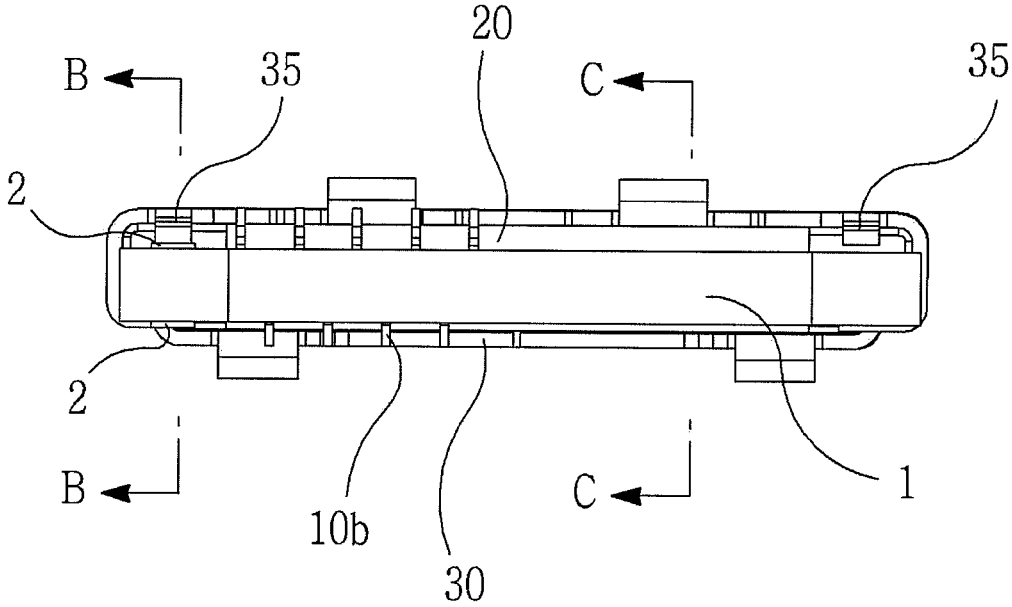
FIG. 15 is a side view of the plug connector in FIG. 14.
Figure 16:
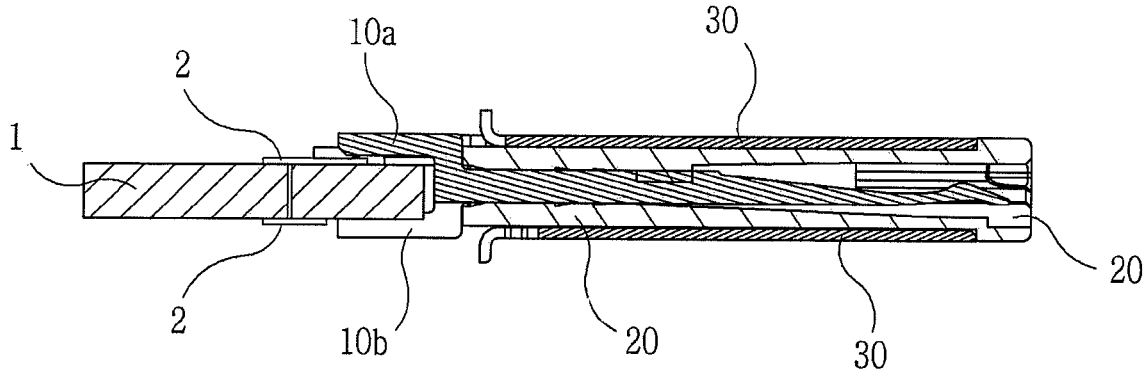
FIG. 16 is a schematic sectional view of the plug connector in FIG. 15 taken along line B-B.

Referring to FIGS. 14, 15 and 16, the ground portion 35 is soldered to the ground circuit 2. Like this, the ground portion 35 is put to earth by the ground circuit 2 so that the outer shell 30 is put to earth. Therefore, the outer shell 30 is not applied an electric current, which prevents from making a noise in case that the plug connector is used as an earphone jack.

Also, bonding the ground portion 35 with the PCB 1 makes the outer shell 30 to be bonded firmly to the PCB 1. Accordingly, plug connector can be prevented from detached from the PCB 1 when separated from the socket connector.

In this embodiment the PCB 1 includes a support portion 1*a* projected. That is, A support portion 1*a* is extended outwardly from the end of the PCB 1 to be inserted into the PCB receptacle. And the insulator 20 includes a PCB receptacle 25 for receiving the support portion 1*a* of the PCB 1.

Figure 17:
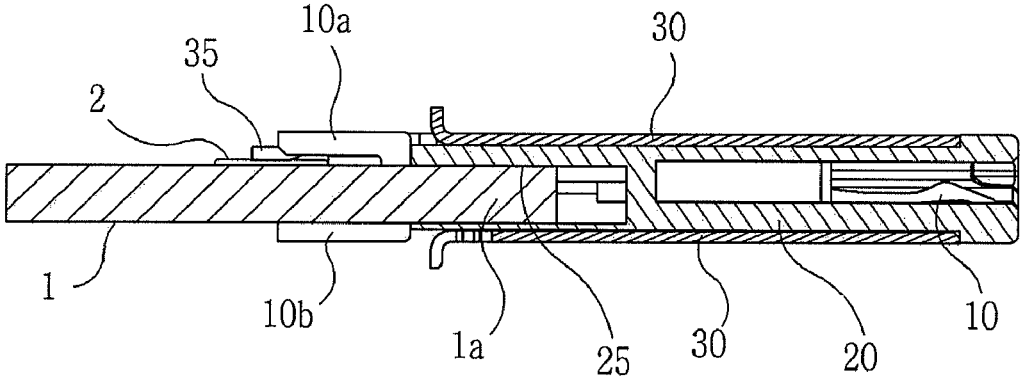
FIG. 17 is a schematic sectional view of the plug connector in FIG. 15 taken along line C-C.

Referring to FIGS. 14 and 17, the support portion 1*a* of the PCB 1 is inserted into the PCB receptacle 25 of the insulator 20 so that the insulator 20 is bonded firmly with the PCB 1 without shaken.

That is, the PCB receptacle 25 and the support portion 1*a* is shaped of a nearly rectangular plate to be coupled each other, which prevent the plug connector from rolling and tossing with respect to the PCB 1, simultaneously from detached from the PCB 1.

The contact pins of the plug connector for a mobile communication device according to the present invention are capable of preventing from making a noise in the earphone by putting to earth the outer shell 30 and are capable of firmly bonding with a PCB.

Also, the plug connector for a mobile communication device is capable of preventing defective contact between contact pins and a socket of the connector through a firm coupling between the contact pins and an insulator, and capable of preventing short circuits between contact pins by guiding each of the contacting ends of the pins.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A plug connector for a mobile communication device, comprising:

a plurality of contact pins provided correspondingly to contact terminals of a socket connector for the mobile communication device, and arranged with predetermined gaps therebetween;

an insulator supporting the contact pins; and an outer shell enclosing the insulator, and including a shell body and a substrate supporter extended outwardly from a front end of the shell body, to support a PCB insertable therein, wherein the substrate supporter comprises side supporters extended outwardly from the front end of the shell body, respectively, and being formed in the shape of 't'' to enclose and support the lateral sides of the PCB, an upper supporter extended outwardly from the front end of the shell body and bent toward the PCB to support an upper surface of the PCB and a lower supporter extended outwardly from the front end of the shell body to support a lower surface of the PCB.

2. The plug connector of claim 1, wherein the substrate supporter comprises a ground portion bonded to put to earth to a ground circuit of a PCB.

3. The plug connector of claim 2, wherein the ground portion is extended outwardly from end of the side supporter.

4. The plug connector of claim 1, wherein the insulator includes a PCB receptacle for receiving a part of a PCB, and the PCB includes a support portion extended outwardly from the end thereof to be inserted into the PCB receptacle.

5. The plug connector of claims 1, wherein the insulator includes a recess for receiving front ends of the contact pins, each of the contact pins includes a contact portion for contacting a contact terminal of the socket connector, and the contact portion has a guide portion protruding from an end thereof for inserting in the recess.

6. The plug connector of claim 5, wherein each of the contact pins has a rear bent portion for contacting an outer surface of the PCB, the rear bent portion being exposed outwardly from the outer shell.

* * * * *